US012774507B2

(12) United States Patent
Leder et al.

(10) Patent No.: US 12,774,507 B2
(45) Date of Patent: Oct. 27, 2026

(54) MATERIAL FOR THE MANUFACTURE OF HIGH-STRENGTH FASTENERS AND METHOD FOR PRODUCING SAME

(71) Applicant: PUBLIC STOCK COMPANY "VSMPO-AVISMA CORPORATION", Sverdlovskaya obl. (RU)

(72) Inventors: Mikhail Ottovich Leder, Voronova (RU); Anatoliy Vladimirovich Volkov, Engelsa (RU); Aleksandr Sergeyevich Grebenshchikov, Engelsa (RU); Nikolay Vasilyevich Shchetnikov, Karla Libknekhta (RU)

(73) Assignee: PUBLIC STOCK COMPANY "VSMPO-AVISMA CORPORATION", Sverdlovskaya obi. (RU)

( * ) Notice: Subject to any disclaimer, the term of this patent is extended or adjusted under 35 U.S.C. 154(b) by 385 days.

(21) Appl. No.: 18/552,343

(22) PCT Filed: Mar. 26, 2021

(86) PCT No.: PCT/RU2021/000128
§ 371 (c)(1),
(2) Date: Sep. 25, 2023

(87) PCT Pub. No.: WO2022/203535
PCT Pub. Date: Sep. 29, 2022

(65) Prior Publication Data

US 2024/0150869 A1 May 9, 2024

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS 8,771,590 B2 * 7/2014 Valentinovich ..... C22C 14/00 420/420
9,816,158 B2 11/2017 Takahashi et al.

FOREIGN PATENT DOCUMENTS

RU 2311248 C1 11/2007
RU 2581332 C2 4/2016
(Continued)

OTHER PUBLICATIONS

Sahoo, R., B. B. Jha, and T. K. Sahoo. "Effect of primary alpha phase variation on mechanical behaviour of Ti—6Al—4V alloy." Materials science and technology 31.12 (2015): 1486-1494.*
(Continued)

*Primary Examiner* — Jessee R Roe
(74) *Attorney, Agent, or Firm* — Myers Bigel, P.A.

(57) ABSTRACT

The invention relates to metallurgy, and more particularly to producing titanium alloy-based materials with specific mechanical properties for the manufacture of fasteners for use in various fields of industry and preferably in the aerospace industry. The claimed material for the manufacture of high-strength fasteners is made from a titanium alloy containing alloying elements in the form of α-stabilizers, #-stabilizers and neutral strengthening elements, the rest being titanium and unavoidable impurities. The size of a beta-subgrain in the structure of the material, which is subjected to solution annealing and aging, does not exceed 15 μm. The material for the manufacture of high-strength fasteners is produced in the form of round bar with a
(Continued)

diameter of up to 40 mm or round wire with a diameter of up to 18 mm, which are subjected to solution annealing and aging After solution annealing and aging, the material has an ultimate tensile strength of greater than 1400 MPa, an elongation of greater than 11%, a reduction in area of greater than 35% and a double shear strength of greater than 750 MPa. An intermediate blank for drawing is obtained by melting an ingot of titanium alloy, thermomechanically processing the ingot to obtain a forged billet and then rolling same. An intermediate blank for drawing is also obtainable using a powder metallurgy method.

10 Claims, 1 Drawing Sheet

(56) References Cited

FOREIGN PATENT DOCUMENTS

| | | | |
|---|---|---|---|
| RU | 2724751 | C1 | 6/2020 |
| WO | 2020101008 | A1 | 5/2020 |
| WO | 2021052929 | A1 | 3/2021 |

OTHER PUBLICATIONS

"Extended European Search Report corresponding to European Application No. 219334000 dated Feb. 7, 2025".

Chen, et al., "Isothermal kinetics of [beta]<->[alpha] transformation in Ti-55531 alloy influenced by phase composition and microstructure", Materials & Design 130:302-316 (May 26, 2017).

David, et al., "Microstructural evolution and mechanical properties of Ti—5Al—5Mo—5V—3Cr after solution heat treatment and ageing in the alpha-beta range By: Roque Panza-Giosa Supervisors", http://coursenotes.mcmaster.ca/701-702_Seminars/2006-2007/702_Roque_Panza-Giosa_Sept_20_07.pdf (Jan. 1, 2006) 44 pages.

Huang, et al., "Effect of microstructure on tensile properties of Ti—5Al—5Mo—5V—3Cr—1Zr alloy", Journal of Alloys and Compound 693:582-591 (Sep. 21, 2016).

Ivasishin, et al., "A comparative study of the mechanical properties of high-strength beta-titanium alloys", Journal of Alloys and Compounds 457296-309 (Jun. 12, 2008).

"International Preliminary Report on Patentability corresponding to International Application No. PCT/RU2021/000128 mailed Jul. 26, 2023".

"International Search Report and Written Opinion corresponding to International Application No. PCT/RU2021/000128 mailed Jun. 16, 2022".

* cited by examiner

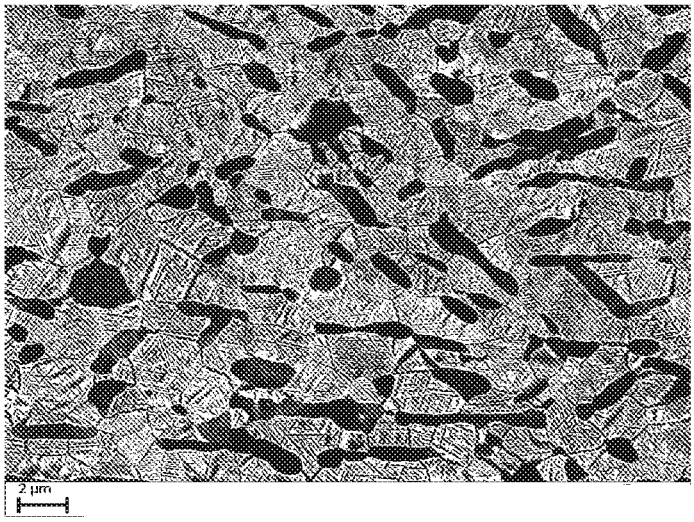
2 μm

MATERIAL FOR THE MANUFACTURE OF HIGH-STRENGTH FASTENERS AND METHOD FOR PRODUCING SAME

STATEMENT OF PRIORITY

This application is a 35 U.S.C. § 371 national phase application of PCT Application No. PCT/RU2021/000128 filed Mar. 26, 2021, the disclosure of which is hereby incorporated herein by reference in full.

FIELD OF THE INVENTION

This invention relates to metallurgy, namely to manufacture of titanium alloy materials with design mechanical properties for producing fasteners used in various industries, primarily in aircraft industry.

BACKGROUND OF THE INVENTION

Due to their high strength-to-weight ratio and high corrosion resistance, titanium based materials find expanding applications in various industries. One of the promising areas is manufacture of fasteners for aircraft and automobile industries. In modern aircraft engineering, for the purpose of structural weight saving, steel fasteners are replaced by items made of high strength titanium alloys. For reliable operation of the items, the threaded fasteners shall have a set of high-level properties, particularly high values of tensile strength and double shear strength. At that, titanium alloys shall approximate in their mechanical properties to the steel materials having ultimate strength a $\sigma_B$—1500 MPa, double shear strength $\tau_{sh}$ —900 MPa, elongation δ—12%. Strength and ductility are the basic mechanical properties of metals and alloys, upon the combination of which the processing and performance properties of fastener material depend directly.

The most cost effective process of fastener external thread manufacture is the process of thread manufacture as a result of plastic deformation of the stock using thread-rolling tool. The profile of the rolled thread is formed by pressing the tool into the stock material and forcing the part of the material into the tool hollows. The state-of-the-art equipment and applicable technologies allow rolling the thread on the material in as-heat hardened condition, i.e. after quenching and artificial aging. At that, compression stresses are generated in the internal turns of the thread, significantly increasing the number of cycles prior to crack initiation, which ensures increased cyclic resistance of the material as a whole. However, thread rolling in as-heat hardened condition is complicated by high strength of the material which along with low ductility severely restricts the technological capabilities of the process and reduces durability of the tool being used. In this regard, the relevant purpose is to create the titanium based material with a combination of high strength and ductility in as-heat hardened condition.

There is a known fastener and the method of its manufacture of alpha-beta titanium alloy, which includes hot rolling, solution treatment and aging of alpha-beta titanium alloy consisting of, in weight %:

| | |
|---|---|
| 3.9 to 4.5 | aluminum; |
| 2.2 to 3.0 | vanadium; |
| 1.2 to 1.8 | iron; |
| 0.24 to 0.3 | oxygen; |
| 0.08 max. | carbon; |

-continued

| | |
|---|---|
| 0.05 max. | nitrogen; |
| 0.3 max. | other elements (total), |

wherein other elements are, in fact, at least either boron, yttrium, each having concentration less than 0.005 and tin, zirconium, molybdenum, chromium, nickel, silicon, copper, niobium, tantalum, manganese and cobalt, each having concentration of 0.1 or less, the balance is titanium and inevitable impurities, hot rolling of titanium alloy in alpha-beta field to produce a stock; annealing of the produced stock at a temperature of 1200° F. (648.9° C.) to 1400° F. (760° C.) for 1 to 2 hours; air cooling; machining to the predetermined product size; solution treatment at a temperature of 1500° F. (815.6° C.) to 1700° F. (926.7° C.) for 0.5 to 2 hours; cooling at a rate at least equivalent to cooling in the air; aging at a temperature of 800° F. (426.7° C.) to 1000° F. (537.8° C.) for 4 to 16 hours; and air cooling (RF patent of invention No. 2581332, IPC C22C 14/00, C22F 1/18, published on 20 Apr. 2016).

However, the level of tensile strength of the known material, at which thread rolling in as-heat hardened condition is possible, is limited to 1370 MPa.

There is a known manufacturing method for titanium alloy bars, which includes production of the stock, its hot rolling to a bar, with manufacture of the stock from ingot and etching of the hot rolled bar, its vacuum annealing, drawing, annealing of the drawn bar and its machining to the final size; at that, air annealing of the drawn bar is performed in two stages: first at a temperature of 650-750° C. for 15 to 60 minutes with air cooling down to room temperature, then at a temperature of 180-280° C. for 4 to 12 hours with air cooling down to room temperature; at that, in the second option the annealing is first performed at a temperature of 750-850° C. for 15 to 45 minutes with cooling down in the furnace to 500-550° C. with subsequent air cooling down to room temperature, then at a temperature of 400-500° C. for 4 to 12 hours with air cooling down to room temperature (RF patent of invention No. 2311248, IPC C22F 1/18, B21C 37/04, published on 27 Nov. 2007).

The known method is intended for the manufacture of fastener stocks of Vt16 titanium alloy and does not take into account the processing characteristics of other high-strength materials and alloys, which leads to low tensile strength and double shear strength.

BRIEF DESCRIPTION OF THE DRAWING

FIG. 1 is an image of a high strength fastener material microstructure obtained by microscopy at 4000x magnification, shown in longitudinal direction.

DETAILED DESCRIPTION OF THE INVENTION

This invention aims at manufacture of high strength fastener material of titanium alloy with a set of high-level mechanical properties which allows performing thread rolling in as-heat hardened condition.

The technical results achieved in the embodiment of the invention are the improved strength properties of the material while maintaining a high level of ductility.

This technical result is achieved by the fact that in the material for high strength fasteners manufactured of titanium alloy containing alloying elements as alpha stabilizers, beta stabilizers, neutral strengtheners, the balance is titanium and inevitable impurities, according to the invention, the total amount of alloying elements ensuring solution strengthening of titanium alloy alpha phase is defined by the following equation:

$$[Al]_{eq}=[Al]+[O]\times10+[C]\times10+[N]\times20+[Zr]/6, \text{ weight } \%,$$

with the concentration of each specific element in the following range:

| | |
|---|---|
| 3.0 to 6.5 | aluminum |
| 0.05 max. | nitrogen |
| 0.05 to 0.3 | oxygen |
| 0.1 max. | carbon |
| 2.0 max. | zirconium, |

where $[Al]_{eq}$ is aluminum structural equivalent, the value of which in the alloy is in the range of 5.1 to 9.3, and the total amount of elements ensuring solution strengthening and also increasing the volume fraction of metastable beta phase is defined by the following equation:

$$[Mo]_{eq}=[Mo]+[V]/1.4+[Cr]\times1.67+[Fe]\times2.5, \text{ weight } \%,$$

with the concentration of each specific element in the following range:

| | |
|---|---|
| 4.0 to 6.5 | vanadium |
| 4.0 to 6.5 | molybdenum |
| 2.0 to 3.5 | chromium |
| 0.2 to 1.0 | iron, |

where $[Mo]_{eq}$ is molybdenum structural equivalent, the value of which in the alloy is in the range of 12.4 to 17.4, at that, the volume fraction of primary alpha in the structure of the solution treated and aged material is in the range of 15 to 27%. Plasticity ratio of the solution treated and aged material ($K_{pm}$) within the tensile strength range of 1400 to 1500 MPa, defined by the integral equation:

$$K_{pm}=\int R_A d\sigma_B,$$

where $R_A$ is reduction of area, %;

$\sigma_B$ is tensile strength, MPa, is in the range of $3.7\times10^3$ до $5.0\times10^3$.

The size of beta-subgrain in the structure of solution treated and aged material does not exceed 15 μm. The material for high strength fastener manufacture is made in the form of a round bar with the diameter up to 40 mm, which was solution treated and aged. The material for high strength fastener manufacture is made in the form of a round wire with diameter up to 18 mm, which was solution treated and aged. The solution treated and aged high strength fastener material has tensile strength over 1400 MPa, elongation over 11% and reduction of area over 35%. The solution treated and aged high strength fastener material has double shear strength over 750 MPa.

This technical result is also achieved by the fact that in the manufacturing method for high strength fastener material, which includes manufacture of the intermediate drawing stock of titanium alloy, manufacture of cold-drawn stock and its final heat treatment, according to the invention, the intermediate drawing stock is manufactured of titanium alloy containing alloying elements as alpha stabilizers, beta stabilizers, neutral strengtheners, the balance is titanium and inevitable impurities, at that, the total amount of the alloying elements ensuring solution strengthening of titanium alloy alpha phase is defined by the following equation:

$$[Al]_{eq}=[Al]+[O]\times10+[C]\times10+[N]\times20+[Zr]/6, \text{ weight } \%,$$

with the concentration of each specific element in the following range:

3.0 to 6.5 aluminum
0.05 max. nitrogen
0.05 to 0.3 oxygen
0.1 max. carbon
2.0 max. zirconium where $[Al]_{eq}$ is aluminum structural equivalent, the value of which in the alloy is in the range of 5.1 to 9.3, and the total amount of elements ensuring solution strengthening and also increasing the volume fraction of metastable beta phase is defined by the following equation:

$$[Mo]_{eq}[Mo]+[V]/1.4+[Cr]\times1.67+[Fe]\times2.5, \text{ weight } \%,$$

with the concentration of each specific element in the following range:

| | |
|---|---|
| 4.0 to 6.5 | vanadium |
| 4.0 to 6.5 | molybdenum |
| 2.0 to 3.5 | chromium |
| 0.2 to 1.0 | iron |

where $[Mo]_{eq}$ is molybdenum structural equivalent, the value of which in the alloy is in the range of 12.4 to 17.4, prior to drawing, the intermediate stock is annealed at a temperature of (BTT-20)° C.-(BTT-50)° C., (where BTT is beta transus temperature), with subsequent cooling down to room temperature at an arithmetic mean rate of at least 15° C./min, a cold-drawn stock is produced via drawing with elongation ratio of 1.8 to 5, at that, final heat treatment of a cold-drawn stock is performed under the following conditions: solution treatment after metal heating to the temperature of (BTT-50)° C.-(BTT-80)° C. with holding for 1 to 8 hours and subsequent cooling down at an arithmetic mean rate of over 10° C./min to the temperature lower or equal to subsequent aging temperature, aging at a temperature of metal heating 400 to 530° C. for at least 8 hours with subsequent cooling down to room temperature. The intermediate drawing stock is manufactured by melting of titanium alloy ingot, thermomechanical treatment of ingot to produce a forged billet and its subsequent rolling. The intermediate drawing stock is manufactured by powder metallurgy method.

To manufacture the material, a titanium alloy containing alpha stabilizers (aluminum, oxygen, nitrogen, carbon), beta-stabilizers (vanadium, molybdenum, chromium, iron), neutral strengtheners (zirconium) is used. The principle of manufacture of the material is based on different effects of the specified groups of alloying elements on titanium. Elements equivalent to aluminum (alpha stabilizers and neutral strengtheners) strengthen titanium alloys mainly as a result of solution strengthening, while elements equivalent to molybdenum (beta stabilizers)—both as a result of solution strengthening and as a result of the increased amount of metastable beta phase which ensures precipitation hardening of alloy during aging. Structural equivalents $[Al]_{eq}$ and $[Mo]_{eq}$ disclosed herein are the criteria which, along with the designed processing conditions, regulate the process of manufacture of high-quality fastener material.

Aluminum structural equivalent $[Al]_{eq}$ enables assessment of alpha phase stabilization degree, which is simultaneously affected by alpha stabilizing elements present in the alloy: aluminum, oxygen, carbon, nitrogen and zirconium. The set total amount of alloying elements ensuring solution strengthening of titanium alloy, $[Al]_{eq}$ is from 5.1 to 9.3. It enables obtaining the required amount of alpha phase within the whole specified range of chemical composition of titanium alloy, taking into account the temperature and rate parameters of processing.

The values of concentration of each element are defined based on the following principles. Aluminum increases strength-to-weight ratio of the alloy, improves strength and modulus of elasticity of titanium. When aluminum concentration in the alloy is less than 3.0%, the required strength is not achieved and the probability of formation of co-phase deteriorating plastic behavior is also increased, while aluminum concentration in the alloy over 6.5% leads to decrease of the alloy processing ductility and to the probability of formation of $Ti_3Al$ particles which may cause material embrittlement. Presence of oxygen in the range of 0.05 to 0.3% increases strength without plasticity deterioration. Presence of nitrogen in the alloy in concentrations not exceeding 0.05% and carbon in concentrations not exceeding 0.1% has no significant effect on the decrease in plasticity at room temperature. To increase alpha phase strength, the alloy is additionally alloyed with zirconium not exceeding 2.0%, which improves strength of the alloy practically not decreasing its plasticity and crack resistance.

Addition of vanadium, molybdenum, chromium and iron concentrations to the alloy corresponding to molybdenum equivalent $[Mo]_{eq}$, from 12.4 to 17.4, enables decreasing the critical cooling rate and ensures maintenance of metastable beta phase during air cooling of sections up to 40 mm and heavier, ensures formation of large amount of metastable beta phase required for obtaining high strength after aging as well as increased processing ductility during cold working.

At that, the concentration of each element is additionally defined among beta stabilizers. Vanadium having high solubility in titanium, in the range of 4.0 to 6.5% increases heat hardenability and ensures beta phase stabilization and also alpha phase strengthening. Alloying with molybdenum in the range of 4.0 to 6.5% effectively increases strength at room temperature and at elevated temperatures, and also increases thermal stability of alloys containing chromium and iron. Chromium concentration set in the range of 2.0 to 3.5% is conditioned by the capability of this element to act as a strong beta stabilizer and to strengthen titanium alloys significantly. When alloying with chromium exceeds 3.5%, there is a probability of formation of intermetallic phase TiCr2 causing the alloy embrittlement. Addition of iron in the range of 0.2 to 1.0% increases processing ductility during hot working of alloy, which enables to prevent deformation defects. The concentration of iron over 1.0% increases chemical homogeneity during alloy melting and solidification, which leads to inhomogeneity of structure and, as a consequence, to inhomogeneity of mechanical properties. The increased plasticity of the material in as-heat hardened condition ensures the combination of a large number on sub-boundaries with the size of beta-subgrain up to 15 μm and the presence of grain-boundary dislocations at the boundaries/subboundaries and also long interphase boundaries ensured by primary alpha particles in the volume fraction 15÷27%.

The capability of the heat hardened material to thread rolling without fracture, with the tensile strength over 1400 MPa, is characterized by the following mathematical relation established experimentally:

$$K_{pm}=\int R_A d\sigma_B;$$

where $K_{pm}$ is plasticity ratio of the heat hardened material, equaling from $3.7\times10^3$ до $5.0\times10^3$;

$R_A$—reduction of area, %;

$\sigma_B$—tensile strength in the range of 1400 to 1500 MPa.

The nature of the proposed manufacturing method for high strength fastener material is based on the following as stated below.

To produce the material, an intermediate drawing stock is manufactured from titanium alloy containing alloying elements as alpha stabilizers, beta stabilizers, neutral strengtheners, the balance is titanium and inevitable impurities.

The design chemical composition of ingot is determined based on the relation of values of the total amount of the alloying elements ensuring solution strengthening of titanium alloy alpha phase and defined by the following equation:

$$[Al]_{eq}=[Al]+[O]\times10\pm[C]\times10\pm[N]><20+[Zr]/6, \text{ weight } \%,$$

with the concentration of each specific element in the following range:

| | |
|---|---|
| 3.0 to 6.5 | aluminum |
| 0.05 max. | nitrogen |
| 0.05 to 0.3 | oxygen |
| 0.1 max. | carbon |
| 2.0 max. | zirconium |

where $[Al]_{eq}$ is aluminum structural equivalent, the value of which in the alloy is in the range of 5.1 to 9.3, and the total amount of elements ensuring solution strengthening and also increasing the volume fraction of metastable beta phase is defined by the following equation:

$$[Mo]_{eq}=[Mo]+[V]/1.4+[Cr]\times10.67+[Fe]\times2.5, \text{weight } \%,$$

with the concentration of each specific element in the following range:

| | |
|---|---|
| 4.0 to 6.5 | vanadium |
| 4.0 to 6.5 | molybdenum |
| 2.0 to 3.5 | chromium |
| 0.2 to 1.0 | iron |

where $[Mo]_{eq}$ is molybdenum structural equivalent, the value of which in the alloy is in the range of 12.4 to 17.4, One of the optional methods of the intermediate stock manufacture is melting of ingot, its thermomechanical treatment by conversion into forged stock (billet) at temperatures of beta and/or alpha-beta phase field. To remove a gas-saturated layer and surface deformation defects, it is expedient to machine the forged billet. The billet is subsequently rolled to produce the intermediate stock in the form of a rolled bar. There are other optional methods of the intermediate stock manufacture, including powder metallurgy method.

Maximum diameter of the produced drawing stock can be limited only by the capacities of the drawing equipment used for cold working, because as the workpiece diameter increases while ensuring an equal degree of deformation, the load on the deforming tooling and specific drawing force increase significantly.

Furthermore, with the increased diameter of the intermediate drawing stock, the inhomogeneity of sectional deformation increases due to accumulation of deformation inhomogeneity of circumferential and central stock layers during subsequent drawing, which consequently leads to inhomogeneity of structure of the finished product.

Prior to drawing, the intermediate stock is annealed, including the vacuum annealing at a temperature of (BTT-20)° C.-(BTT-50)° C. with subsequent cooling down at an arithmetic mean rate of at least 15° C./min. Heating of the intermediate stock with the specified chemical composition in the temperature range of (BTT-20)° C.-(BTT-50)° C. allows obtaining the structure containing metastable matrix beta phase with the portion of primary alpha in the range of 6 to 17%. During the plastic cold deformation process, primary alpha phase is an obstacle to the movement of dislocations as it reduces their way up to the distance between the alpha phase particles. The portion of primary alpha phase required for stress redistribution and homogenization prior to subsequent drawing, in the range of 6 to 17% contributes to the effective accumulation of dislocations during further cold deformation, determining subsequent return, polygonization and recrystallization processes. Cooling down from annealing temperature at an arithmetic mean rate over 15° C./min enables maintenance of metastable beta phase without its breakdown, and also the maintenance of the established amount of primary alpha phase. Furthermore, the specified rate helps to avoid formation of secondary alpha phase, the presence of which significantly increases strengthening ratio and prevents from obtaining high drawing ratios at the subsequent stage of plastic deformation process.

Drawing of the intermediate stock is performed at room temperature with the drawing ratio in the range of 1.8 to 5. During the drawing process, density of dislocations significantly increases in beta phase as well as at the interphase boundaries and in alpha phase. Primary alpha particles in the amount of 6 to 17% enable optimal distribution of dislocations along the flow lines, thus creating their uniform distribution in the material volume. With the drawing ratio over 1.8, cellular structure is formed in the material and is stabilized, which during solution treatment, ensures the required size and number of beta-subgrain. The drawing ratio less than 1.8 does not ensure stability of cellular structure during subsequent solution treatment even at the temperature range extension, due to low specific portion of the cells transformed to beta-subgrain, which leads to the increase in beta-subgrain size and does not allow to ensure the values of mechanical properties after final heat treatment. Maximum drawing ratio is characterized by extreme damageability of the material prior to fracture, which to a great extent depends on the drawing parameters and the starting stock structure. After drawing, the material in the form of a wire or a bar is subjected to heat hardening consisting of solution treatment and subsequent artificial aging.

Solution treatment is performed under the following conditions: heating of the material to the temperature of (BTT-50)° C.-(BTT-80)° C., holding time at the prescribed temperature for 1 to 8 hours, cooling down to the temperature lower or equal to subsequent aging temperature at the arithmetic mean rate over 10° C./min.

The specified conditions are aimed at obtaining the required parameters of alpha and beta phases. During this heat treatment, as a result of transformations and redistribution of dislocations, a structure with the increased volume fraction of primary alpha phase up to 15 to 27% is obtained and beta subgrain with the size not exceeding 15 pm is present in the structure.

Heating of the material above the specified temperature range results in significant increase in beta grain size and reduces the volume fraction of alpha phase that eventually results in decrease in ductility of the material in the final state. The volume fraction of alpha phase increases during heating of the material to the temperature below (BTT-80)° C. thus making it difficult to obtain strength over 1450 MPa after aging. Minimum holding time during heating to solution treatment temperature for 1 hour is conditioned by the sufficiency of the on-going processes of cellular structure transformation into subgrain structure, and holding of the material for more than 8 hours increases the subgrain size thus resulting in decrease in ductility. Arithmetic mean cooling rate 10° C./min is the minimum rate ensuring no breakdown of metastable beta phase during solution treatment, the maintenance of primary alpha phase portion, thus restraining primary alpha phase formation.

After solution treatment, artificial aging of the material is performed at a temperature of 400 to 530° C. for over 8 hours.

Artificial aging of the material at a temperature of 400 to 530° C. allows varying the values of tensile strength within the range from 1400 MPa, with regard to values of solution treatment temperature range, and also finalizing formation of the structure which along with solution treatment allows obtaining increased plasticity, ensuring the value of material elongation of at least 11%. Aging temperature range is conditioned by obtaining the required strength of the material which subsequently determines strength of the produced fasteners. Selection of aging temperature range is conditioned by the degree of stability of alpha phase which breaks down during aging, and also by the dispersion of the precipitating secondary alpha phase which predetermines obtaining of high material strength values. Duration of aging for at least 8 hours ensures complete breakdown of beta phase and bringing the material to equilibrium.

Industrial applicability of the invention is proved by the specific example.

To produce the material for fasteners in the form of a wire with the diameter of 8.05 mm, the ingot with the chemical composition shown in Table 1 was melted. The alloy beta transus temperature (BTT) determined by metallographic method was equal to 838° C.

TABLE 1

| Sampling area | Concentration of elements, weight % | | | | | | | | | | Values of structural equivalents |
|---|---|---|---|---|---|---|---|---|---|---|---|
| | Al | V | Mo | Fe | Cr | Zr | O | N | C | | |
| Ingot top | 4.56 | 5.12 | 4.92 | 0.43 | 2.74 | 0.80 | 0.190 | 0.012 | 0.014 | Balance - titanium and | $[Al]_{eq}$ = 6.9 $[Mo]_{eq}$ = 14.2 |

TABLE 1-continued

| Sampling area | Concentration of elements, weight % | | | | | | | | | | Values of structural equivalents |
|---|---|---|---|---|---|---|---|---|---|---|---|
| | Al | V | Mo | Fe | Cr | Zr | O | N | C | | |
| Ingot bottom | 4.59 | 5.09 | 5.12 | 0.37 | 2.65 | 0.82 | 0.164 | 0.011 | 0.008 | inevitable impurities | $[Al]_{eq}$ = 6.7<br>$[Mo]_{eq}$ = 14.1 |

The melted ingot was converted at temperatures of beta and alpha-beta phase fields. The stock was subjected to final conversion to produce forged billets for rolling and subsequent machining. The machined billets were rolled to produce the rolled intermediate stock with the diameter of 13.3 mm, with the temperature of the deformation ending in beta field. As a result, the recrystallized equiaxed beta grain structure is obtained. The intermediate stock with the diameter of 7.9 mm was annealed in the vacuum furnace at a temperature of 802° C. (BTT-36)° C. and cooled down to room temperature at an arithmetic mean rate not exceeding 15° C./min. To remove surface defects and the gas-saturated layer, auxiliary operations were performed to produce the stock with the diameter of 12.3 mm. The 12.3 mm diameter stock was drawn at room temperature to the diameter of 8.6 mm. This was followed by removal of surface defects and a gas-saturated layer by abrasive grinding and pickling during which the stock diameter was reduced to 8.05 mm. This was followed by heat hardening of the wire material under the following conditions: solution treatment during heating to 768° C. (BTT-70)° and holding for 4 hours, air cooling to room temperature at an arithmetic mean rate of at least 10° C./min; artificial aging at a temperature of 500° C., holding for 8 hours, air cooling. The results of mechanical testing of material of the wire with the diameter of 8.05 mm in as-heat hardened condition are given in Table 2. The material microstructure in longitudinal direction at magnification 4000× is shown in FIG. 1.

TABLE 2

| Specimen number | Tensile properties | | | Double shear strength, (MPa) |
|---|---|---|---|---|
| | Ultimate tensile strength, (MPa) | Elongation, % | Reduction of area, % | |
| 1 | 1428 | 13.0 | 46.3 | 809 |
| 2 | 1426 | 14.0 | 51.0 | 792 |
| 3 | 1426 | 14.0 | 52.0 | 792 |

Thus, the claimed material for high strength fasteners is characterized by the increased level of processing and performance properties which are obtained by optimization of chemical composition and concentrations of alloying elements in titanium alloy and also by optimization of process conditions of its conversion and heat treatment which ensure obtaining of the specified microstructure.

The invention claimed is:

1. A manufacturing method for fastener material, which includes manufacture of the intermediate drawing stock of titanium alloy, manufacture of cold-drawn stock and its final heat treatment, characterized by the manufacture of the drawing stock of titanium alloy containing alloying elements as alpha stabilizers, beta stabilizers, neutral strengtheners, the balance is titanium and inevitable impurities, at that, the total amount of the alloying elements ensuring solution strengthening of titanium alloy alpha phase is defined by the following equation:

$$[Al]_{eq}=[Al]+[O]\times10+[C]\times10+[N]\times20+[Zr]/6, \text{ weight } \%,$$

with the concentration of each specific element in the following range:

| | |
|---|---|
| 3.0 to 6.5 | aluminum |
| 0.05 max. | nitrogen |
| 0.05 to 0.3 | oxygen |
| 0.1 max. | carbon |
| 2.0 max. | zirconium |

where $[Al]_{eq}$ is aluminum structural equivalent, the value of which in the alloy is in the range of 5.1 to 9.3, and the total amount of elements ensuring solution strengthening and also increasing the volume fraction of metastable beta phase is defined by the following equation:

$$[Mo]_{eq}=[Mo]+[V]/1.4+[Cr]\times1.67+[Fe]\times2.5, \text{ weight } \%,$$

with the concentration of each specific element in the following range:

| | |
|---|---|
| 4.0 to 6.5 | vanadium |
| 4.0 to 6.5 | molybdenum |
| 2.0 to 3.5 | chromium |
| 0.2 to 1.0 | iron |

where $[Mo]_{eq}$ is molybdenum structural equivalent, the value of which in the alloy is in the range of 12.4 to 17.4, prior to drawing, the intermediate stock is annealed at a temperature of (BTT-20° C.)-(BTT-50° C.) (where BTT is beta transus temperature) and cooled down to room temperature at an arithmetic mean rate of at least 15° C./min, a cold-drawn stock is produced via drawing with elongation ratio of 1.8 to 5, at that, final heat treatment of a cold-drawn stock is performed under the following conditions: solution treatment after metal heating to the temperature of (BTT-50° C.) -(BTT-80° C.) with holding for 1 to 8 hours and subsequent cooling down at an arithmetic mean rate of over 10° C./min to the temperature lower or equal to subsequent aging temperature, aging at a temperature of metal heating 400 to 530° C. for at least 8 hours with subsequent cooling down to room temperature.

2. The manufacturing method for the material under claim 1, characterized by manufacture of the intermediate drawing stock by melting of titanium alloy ingot, thermomechanical treatment of ingot to produce a forged billet and its subsequent rolling.

3. The manufacturing method for the material under claim 1, characterized by manufacture of the intermediate drawing stock by powder metallurgy method.

4. The manufacturing method for the material under claim 1, characterized by the fastener material being made in the form of a round bar with a diameter of up to 40 mm.

5. The manufacturing method for the material under claim 1, characterized by the fastener material being made in the form of a round wire with a diameter of up to 18 mm.

6. The manufacturing method for the material under claim 1, characterized by the fastener material having a structure with a volume fraction of primary α-phase from 15% to 27%.

7. The manufacturing method for the material under claim 1, characterized by the fastener material having a structure with a size of beta-subgrain not exceeding 15 μm.

8. The manufacturing method for the material under claim 1, characterized by the fastener material having a tensile strength of more than 1400 MPa.

9. The manufacturing method for the material under claim 1, characterized by the fastener material having an elongation of more than 11% and a reduction of area of more than 35%.

10. The manufacturing method for the material under claim 1, characterized by the fastener material having a double shear strength of more than 750 MPa.

* * * * *